US007870862B2

(12) United States Patent
Yuhara et al.

(10) Patent No.: US 7,870,862 B2
(45) Date of Patent: Jan. 18, 2011

(54) VANITY CASE

(75) Inventors: Yukitomo Yuhara, Chiba (JP); Yuzo Yoshida, Tokyo (JP)

(73) Assignee: Yoshida Industry Co., Ltd., Tokyo (JP)

( * ) Notice: Subject to any disclaimer, the term of this patent is extended or adjusted under 35 U.S.C. 154(b) by 759 days.

(21) Appl. No.: 11/733,792

(22) Filed: Apr. 11, 2007

(65) Prior Publication Data

US 2007/0246060 A1 Oct. 25, 2007

(30) Foreign Application Priority Data

Apr. 21, 2006 (JP) ..... 2006-118526
Apr. 21, 2006 (JP) ..... 2006-118527

(51) Int. Cl.

| | |
|---|---|
| ***A45D 33/00*** | (2006.01) |
| ***B65D 43/26*** | (2006.01) |
| ***B65D 45/16*** | (2006.01) |
| ***B65D 43/14*** | (2006.01) |
| ***B65D 43/04*** | (2006.01) |

(52) U.S. Cl. ..... 132/293; 220/264; 220/326; 220/835; 220/281

(58) Field of Classification Search ..... 132/293–296, 132/287, 301; 220/507, 23.87, 23.89, 281, 220/326, 835, 263, 265; 206/235; 215/209
See application file for complete search history.

(56) References Cited

U.S. PATENT DOCUMENTS

| | | | | |
|---|---|---|---|---|
| 3,087,656 | A * | 4/1963 | Dougherty | 222/518 |
| 4,483,355 | A * | 11/1984 | Yuhara | 132/301 |
| 7,296,730 | B2 * | 11/2007 | Erdie | 229/125.17 |

FOREIGN PATENT DOCUMENTS

| | | |
|---|---|---|
| FR | 2534787 | 4/1984 |
| FR | 2892275 | 4/2007 |
| JP | 2004-209029 | 7/2004 |
| JP | 2005-130889 | 5/2005 |
| JP | 2006288766 | 10/2006 |

* cited by examiner

*Primary Examiner*—Rachel R Steitz
(74) *Attorney, Agent, or Firm*—Harness, Dickey & Pierce, PLC

(57) ABSTRACT

A vanity case in which a lid is coupled to part of peripheral walls of its case body pivotably and a slide piece is slidably mounted in the case body such that when the slide piece is at a first position, the lid is closed against the case body and that when the slide piece has moved from the first position to a second position, the lid is open relative to the case body. Formed through adjacent part of a bottom wall of the case body to one of the peripheral walls is a slit extending along the peripheral wall such that the peripheral wall adjacent to the slit bends inwards when an inward external force is exerted on the peripheral wall, and the deformation of the peripheral wall acts as an external force on the slide piece to make the slide piece move to the second position.

6 Claims, 15 Drawing Sheets

VANITY CASE

CROSS-REFERENCE TO RELATED APPLICATIONS

The present application claims priority from Japanese Patent Applications No. 2006-118526 and No. 2006-118527 filed on Apr. 21, 2006, which are herein incorporated by reference.

BACKGROUND OF THE INVENTION

1. Field of the Invention

The present invention relates to a vanity case wherein the engagement between its lid and case body can be released easily by an operation of pressing the case body.

2. Description of the Related Art

An example of a vanity case that has the front wall of its case body formed as a portion for pushing operation is disclosed in Japanese Patent Application Laid-Open Publication No. 2004-209029 (conventional example 1). The vanity case described therein comprises a case body that contains cosmetic material; a lid openably close against the case body; a first engaging protrusion formed on the inwards facing side of the front wall of the lid; an elastic portion formed at the front wall of the case body below the first engaging protrusion of the lid to have a slit formed along the front wall through the bottom of the case body so as to be elastically deformable horizontally; a second engaging protrusion formed protruding upwards from the elastic portion so as to detachably engage with the first engaging protrusion and to be moved horizontally following the elastic deformation of the elastic portion to disengage from the first engaging protrusion; and a protrusion formed extending downwards from the lid so as to contact the second engaging protrusion being moved so that the lid is raised.

Furthermore, an example of a vanity case wherein the engagement between the case body and the lid is released with push pieces provided on the sides of the case body is disclosed in Japanese Patent Application Laid-Open Publication No. 2005-130889 (conventional example 2). The vanity case is described therein wherein the lid is pivotably coupled to the case body at its rear end and has an engaging protrusion at its front underside and wherein an elastic member is provided inside the case body and has an engaging tab at its front end to engage with the engaging protrusion of the lid. The engagement between the engaging tab and the engaging protrusion is released when the elastic member is moved rearwards. A pair of push pieces connected to the elastic member are provided on the sides of the case body so as to be exposed to the outside, and when the push pieces are pushed inwards with fingers, the elastic member is moved rearwards.

In the conventional example 1, because the second engaging protrusion that engages with the first engaging protrusion is formed on the elastic portion of the case body, the second engaging protrusion has to be of the same material as the case body. For example, if the material of the case body is rigid, the second engaging protrusion is easy to break. On the other hand, if the material of the case body is soft, the problem occurs that the engagement with the first engaging protrusion is easy to be released. Moreover, since an open space in communication with the slit is formed between the front wall of the case body and a cosmetic material containing portion of the case body, pieces of the cosmetic material that have flown in a scattered manner from the containing portion are likely to firmly stick to the inside of the slit. Because the width of the slit is small, the inside of the slit is not easy to clean. Thus, the slit and its surroundings become dirty, which causes the problem that the appearance of the vanity case becomes worse.

In the conventional example 2, the push pieces for pushing operation being exposed at the sides of the case body restricts the design of the vanity case and dirt is likely to stick to the spaces between the push pieces and the sides of the case body. Such dirt will appear on the appearance of the vanity case and thus its beauty is likely to be damaged. Furthermore, because the push pieces are incorporated as components into the case body, the size of the push pieces has to be set to be relatively small, which degrades the operability of the push pieces.

SUMMARY OF THE INVENTION

The present invention was made in view of the above problems of the conventional art, and an object thereof is to provide a vanity case wherein the engagement between its lid and case body can be released easily by an operation of pushing the case body. Another object of the present invention is to provide a vanity case wherein cosmetic material is prevented from making the vanity case dirty.

According to the present invention, there is provided a vanity case in which a lid is coupled to part of peripheral walls of its case body in an openable and closable manner and a slide piece is slidably mounted in the case body such that when the slide piece is at a first position, the lid is closed against the case body and that when the slide piece has moved from the first position to a second position, the lid is open relative to the case body. Formed through adjacent part of a bottom wall of the case body to one of the peripheral walls is a slit extending along the peripheral wall such that the peripheral wall adjacent to the slit bends inwards when an inward external force is exerted on the peripheral wall, and the deformation of the peripheral wall acts as an external force on the slide piece to make the slide piece move to the second position.

The lid may be coupled to the peripheral wall on the rear side of the case body in an openable and closable manner, and the slit may be formed in adjacent part of the bottom wall to the peripheral wall on the front side of the case body.

Alternatively, the lid may be coupled to the peripheral wall on the rear side of the case body in an openable and closable manner, and such slits may be formed respectively in adjacent parts of the bottom wall to peripheral walls on both left and right sides of the case body.

The slide piece may have a sealing portion for sealing the slits from the inside of the case body.

A biasing member biasing the lid toward opening may be provided in between the case body and the lid.

The peripheral wall that bends may be provided with a mark indicating a position for pushing operation.

Features and objects of the present invention other than the above will become apparent from the description of this specification and the accompanying drawings.

BRIEF DESCRIPTION OF THE DRAWINGS

For a more complete understanding of the present invention and the advantages thereof, reference is now made to the following description taken in conjunction with the accompanying drawings wherein.

DETAILED DESCRIPTION OF THE INVENTION

Figure 1:
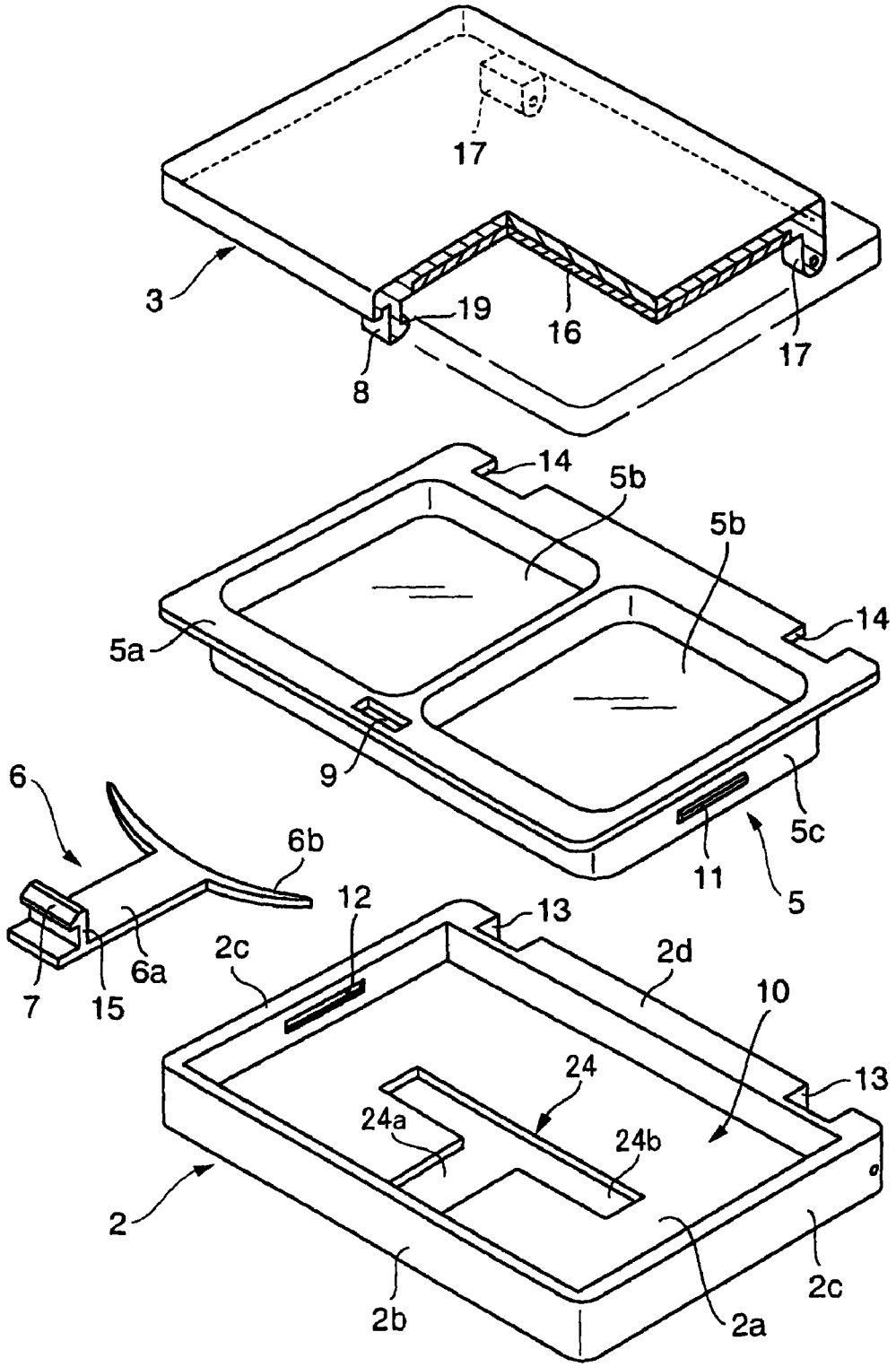
FIG. 1 is an exploded perspective view of a preferred first embodiment of a vanity case according to the present invention.
Figure 2:
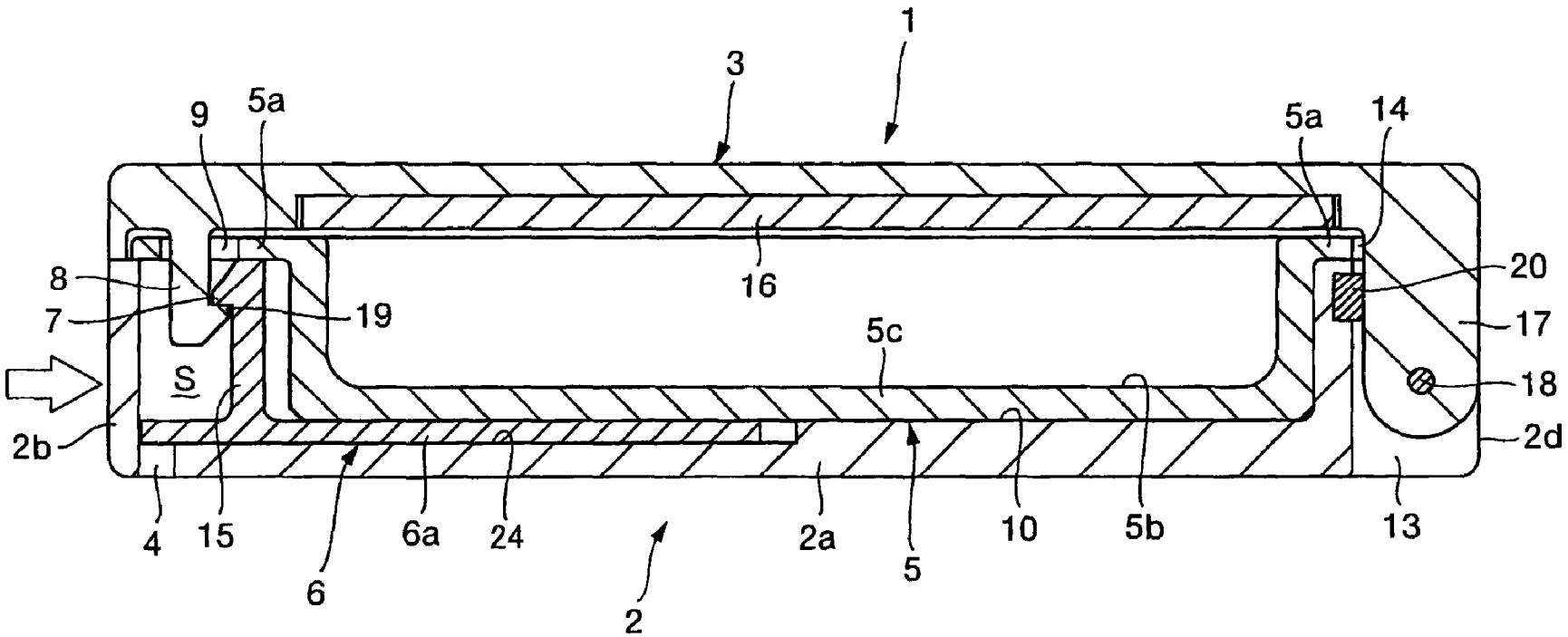
FIG. 2 is a side sectional view of the vanity case of FIG. 1 showing the arrangement of a slide piece and a hinge block.
Figure 3:
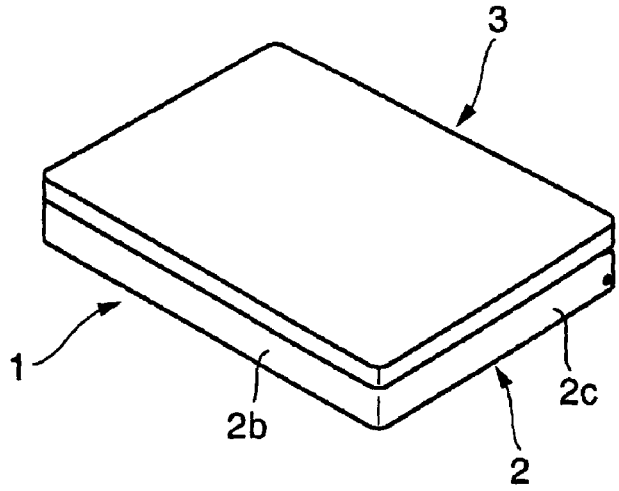
FIG. 3 is a perspective view of the vanity case of FIG. 1 as seen from above front.
Figure 4:
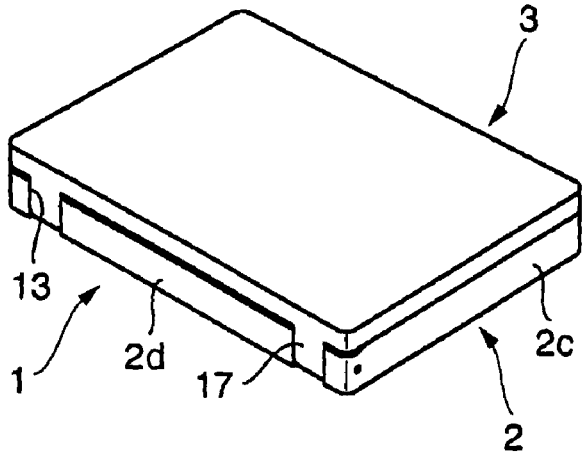
FIG. 4 is a perspective view of the vanity case of FIG. 1 as seen from above behind.
Figure 5:
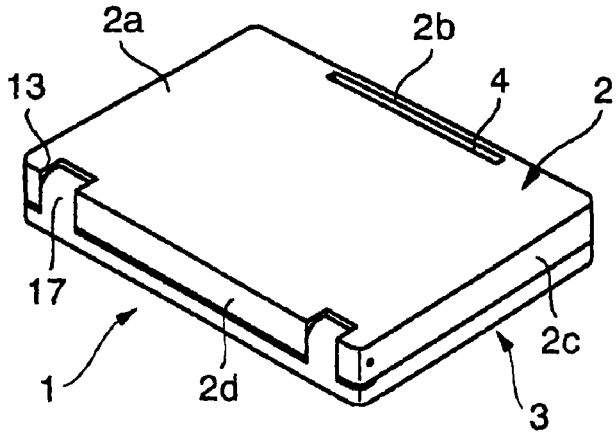
FIG. 5 is a perspective view of the vanity case of FIG. 1 as seen from below behind.

At least the following matters will be made clear by the explanation in the present specification and the description of the accompanying drawings.

A first embodiment of a vanity case according to the present invention will be described below in detail with reference to the accompanying drawings. As shown in FIGS. 1 to 5, the vanity case 1 according to the present embodiment essentially comprises a case body 2 which has a front wall 2*b* presenting continuous front appearance at the front end of a bottom wall 2*a* and which a lid 3 is pivotably coupled to and openably closed against; a slit 4 formed through the bottom wall 2*a* along the length of the front wall 2*b* that renders the front wall 2*b* elastically deformable so as to be able to be pushed backwards; a tray 5 that, when received in the case body 2, is away from the front wall 2*b* by a longitudinal space S in the direction from front to back and has a canopy 5*a* formed extending over the slit 4 to the front wall 2*b* so as to hide the slit; a slide piece 6 provided in the case body 2 so as to be slid in an elastically returnable manner by elastically deforming the front wall 2*b*, the slide piece 6 being hidden by the front wall 2*b*; an engaging portion 7 provided on the slide piece 6 so as to be in the space S; a hook 8 provided on the underside of the lid 3 so as to detachably engage with and disengage from the engaging portion 7 in response to the slide piece 6 sliding; and an opening 9 made in the canopy 5*a* through which the hook 8 is inserted into the space S.

The case body 2 has the front wall 2*b*, left and right walls 2*c*, and a rear wall 2*d* formed respectively at the front, left, right, and rear ends of the bottom wall 2*a*, which form a rectangle in outline in plan view. The front wall 2*b* presents the front appearance of the vanity case 1 that is continuous along its wall surface. Also the left and right walls 2*c* and the rear wall 2*d* present the left, right, and rear appearances of the vanity case 1 that are continuous along their wall surfaces. Formed in the case body 2 is a cavity 10 surrounded by the front wall 2*b*, the left and right walls 2*c*, and the rear wall 2*d* which receives the tray 5 having two containers 5*b* that are filled with cosmetic material or store makeup tools. An engaging groove 12 is formed in each of the sides of the left and right walls 2*c* facing the cavity 10 such that the grooves detachably engage a pair of engaging protrusions 11 formed on the left and right sides of the tray 5 to hold the tray 5 in the cavity 10.

The slit 4 is formed extending laterally along and adjacent to the front wall 2*b* in the bottom wall 2*a*, and the front wall 2*b* is supported at both ends by the left and right walls 2*c* with the presence of the slit 4 and is elastically deformable backwards by pushing operation. The rear wall 2*d* of the case body 2 has a pair of recesses 13 for hinges recessed toward the front of the case body 2 near its left and right ends.

The tray 5 comprises a tray body 5*c* provided with the engaging protrusions 11, and the canopy 5*a*. The tray body 5*c* has a rectangular outline in plan view whose lateral size is substantially the same as that of the cavity 10 and whose longitudinal size is shorter than that of the cavity 10 so as to be away by the longitudinal space S from the front wall 2*b*. The canopy 5*a* is formed protruding outwards from the outer upper edge of the tray body 5*c* to the front wall 2*b*, the left and right walls 2*c*, and the rear wall 2*d* of the case body 2 to overlap them. Because the canopy 5*a* extends so as to overlap the front wall 2*b*, which is away by the longitudinal space S from the tray body 5*c*, the canopy 5*a* functions as a slit cover that covers the slit 4 adjacent to the front wall 2*b* from above. A pair of left and right recesses 14 is formed in the canopy 5*a* to match the hinge recesses 13 of the rear wall 2*d*.

Formed in the bottom wall 2*a* of the case body 2 is a T-shaped groove 24 made up of a longitudinal groove 24*a* extending from the slit 4 toward the rear of the case body 2 and a lateral groove 24*b* extending laterally at the rear end of the longitudinal groove 24*a*. Provided in the groove 24 is the slide piece 6 having such a thickness as to be just accommodated in the groove 24, the slide piece 6 being hidden by the front wall 2*b* in front thereof. The slide piece 6 is separate from and mounted in the case body 2. The slide piece 6 is shorter in the size along the longitudinal groove 24*a* than the longitudinal groove 24*a* and comprises a slide portion 6*a* of which the front end can contact the back side of the front wall 2*b* and which is slidable forwards and backwards in the longitudinal groove 24*a*, and spring pieces 6*b* extending to the left and right in an arc-like shape from the rear end of the slide portion 6*a* which are placed in the lateral groove 24*b* and are resilient against the case body 2 via the lateral groove 24*b* so as to elastically return the slide portion 6*a* forwards that has been slid backwards.

Thus, when the front wall 2*b* is pushed backwards, the slide portion 6*a* is slid against the resilience of the spring pieces 6*b*. When the front wall 2*b* is not pushed, the slide portion 6*a* is biased forwards by the resilience of the spring pieces 6*b*, and thus the front end of the slide portion 6*a* contacts the front wall 2*b*. A leg 15 is formed upright on the front end of the slide piece 6 so as to be in the longitudinal space S, and the engaging portion 7 is formed on the upper end of the leg 15 to protrude forwards. The engaging portion 7 is moved in the longitudinal space S under the canopy 5*a* backwards and forwards in response to the slide of the slide piece 6.

The lid 3 with a mirror plate 16 is coupled to the case body 2 to open and close against the case body 2. A pair of left and right hinge blocks 17 are formed on the rear of the lid 3 such that they are inserted respectively into the pair of left and right hinge recesses 13 in the rear wall 2*d* of the case body 2 through the recesses 14 of the canopy 5*a*. A pair of left and right hinge pins 18 is attached to the case body 2 to pivotably couple the lid 3 to the case body 2 with the hinge blocks 17 being in the hinge recesses 13. The hook 8 is formed on the underside of the front end of the lid 3 to extend downwards, and a tab 19 is formed on the lower end of the hook 8 to protrude backwards so as to detachably engage with the engaging portion 7 of the slide piece 6. The hook 8 disengages from the engaging portion 7 by the slide piece 6 being slid backwards in the case body 2 and engages with it by the slide piece 6 being slid forwards. An opening 9 is made in the canopy 5*a* of the tray 5 through which the hook 8 is inserted in a pullout-able manner into the longitudinal space S in which the engaging portion 7 is.

Furthermore, an elastic body 20 such as a rubber is provided as a biasing member in between the rear wall 2*d* of the case body 2 and the hinge block 17 of the lid 3 at the hinge recess 13. The elastic body 20 protrudes toward the rear of the case body 2 and elastically contacts the hinge block 17 when the lid 3 is closed, thus biasing the lid 3 toward opening via the hinge block 17.

The actions of the vanity case 1 according to the present embodiment will be described. When assembling, the slide piece 6 is placed in the groove 24 in the case body 2, so that the slide piece 6 in the groove 24 is hidden by the front wall 2*b* and that the front end of the slide portion 6*a* contacts the back side of the front wall 2*b*. Then, the tray 5 is mounted in the case body 2 such that the engaging portion 7 of the slide piece 6 is in the longitudinal space S between the front wall 2*b* and the tray body 5*c* and that the slit 4 and the longitudinal space S are hidden by the canopy 5*a*. Thereafter, the hinge blocks 17 of the lid 3 are inserted in the hinge recesses 13 and joined by the hinge pins 18 to the rear wall 2*d* of the case body 2 such that the lid 3 is pivotably coupled to the case body 2.

In the use of the vanity case 1, by closing the lid 3, the hook 8 of the lid 3 enters into the longitudinal space S under the canopy 5*a* through the opening 9 made in the canopy 5*a* of the tray 5. The tab 19 of the hook 8 that has entered contacts and pushes the engaging portion 7 toward the rear of the case body 2, and thereby the slide portion 6*a* is moved backwards against the resilience of the spring pieces 6*b*. Thus, the tab 19 gets under and engages with the engaging portion 7, thereby holding the lid 3 closed against the case body 2.

Conversely, when the lid 3 is opened, the front wall 2*b* of the case body 2 is pushed with a finger or the like. By pushing the front wall 2*b* backwards, the slide piece 6 is slid backwards against the resilience of the spring pieces 6*b* in the case body 2. Thereby, the engaging portion 7 of the slide piece 6 disengages from the tab 19 of the hook 8. Thereafter, the elastic body 20 biasing the lid 3 toward opening raises the lid 3 from the case body 2 to open.

Once the lid 3 is raised by the action of the elastic body 20, when the slide piece 6 has elastically returned, the hook 8 will not engage with the engaging portion 7 again, and thus the lid 3 can be opened smoothly. After the lid 3 is raised by the elastic body 20, by removing the finger from the front wall 2*b*, the slide piece 6 is slid forwards by the spring pieces 6*b*, and the front end of the slide portion 6*a* comes into contact with the back side of the front wall 2*b* and waits for the closing of the lid 3 again.

In the vanity case 1 according to the present embodiment, the case body 2 and the slide piece 6 having the engaging portion 7 can be made of different materials. Thus, the engagement with the hook 8 of the lid 3 can be stabilized structurally, and the engagement and disengagement between the lid 3 and the case body 2 can be maintained appropriate over a long period of time.

The longitudinal space S between the front wall 2*b* and the tray 5 that is necessary to push the front wall 2*b* to deform elastically can be hidden together with the slit 4 by the canopy 5*a*. Thus, when the lid 3 is opened, it can be ensured that the appearance of the vanity case 1 is good. Also, pieces of the cosmetic material that have flown out in a scattered manner from the containers 5*b* that are filled with cosmetic material or store makeup tools can be received by the canopy 5*a*, and thus the vanity case 1 is easy to clean. By this means, the appearance of the vanity case 1 can be kept good. On the other hand, dust that has entered the case body 2 through the slit 4 of the bottom wall 2*a* can be blocked by the canopy 5*a*, thereby preventing the dust from sticking to the tray 5 and its neighbors to dirty them. In addition, although the canopy 5*a* is provided, since the opening 9 is made in the canopy 5*a*, the engagement and disengagement between the hook 8 and the engaging portion 7 and the opening and closing of the lid 3 can be secured appropriately. Furthermore, the entire front wall 2*b* can be used as a portion for pushing operation, thus improving the ease of opening and closing the lid 3.

Because the elastic body 20 biasing the lid 3 toward opening is provided in between the case body 2 and the lid 3, once the engagement between the engaging portion 7 and the hook 8 is released by pushing the front wall 2*b*, they can be prevented from engaging again when the finger is removed from the front wall 2*b*, and thus the lid 3 can be opened smoothly.

Figure 6:
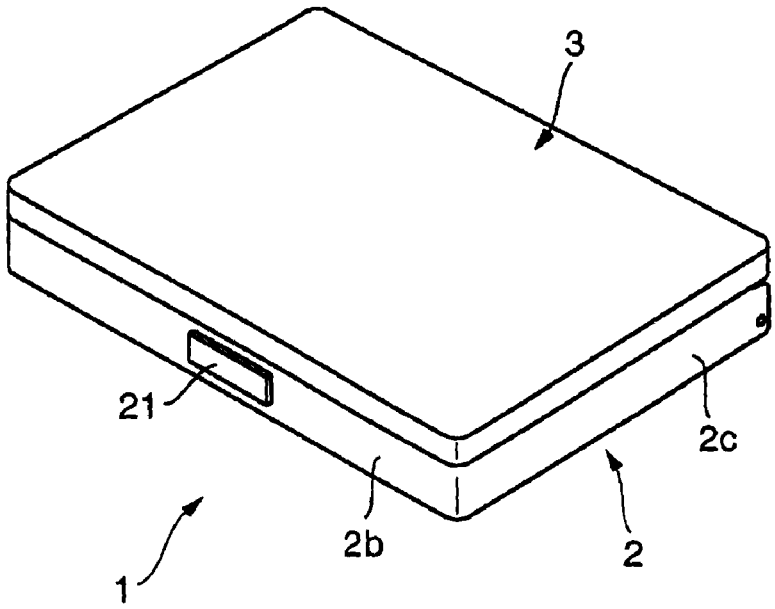
FIG. 6 is a perspective view of a modified example of the vanity case according to the present invention as seen from above front.
Figure 7:
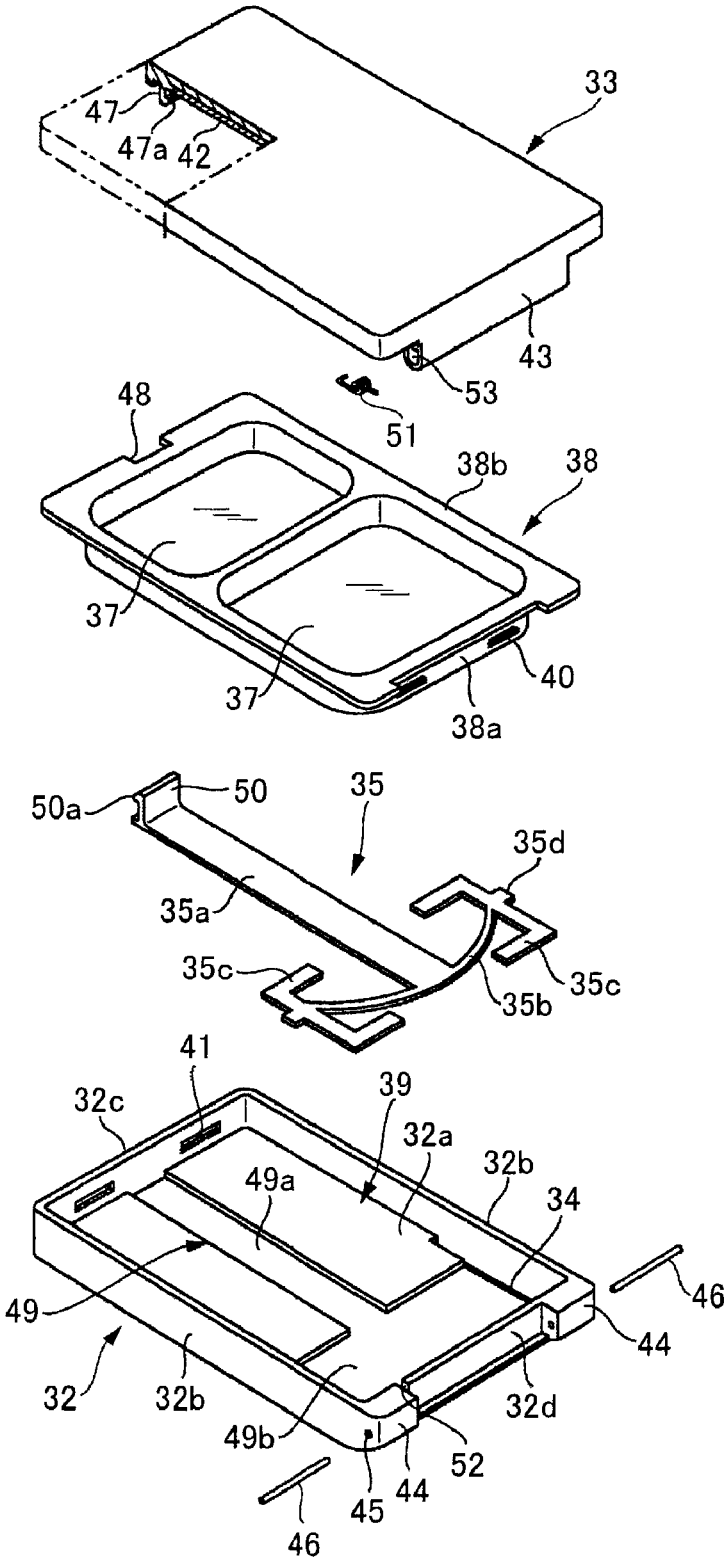
FIG. 7 is an exploded perspective view of a second embodiment of the vanity case according to the present invention.
Figure 8:
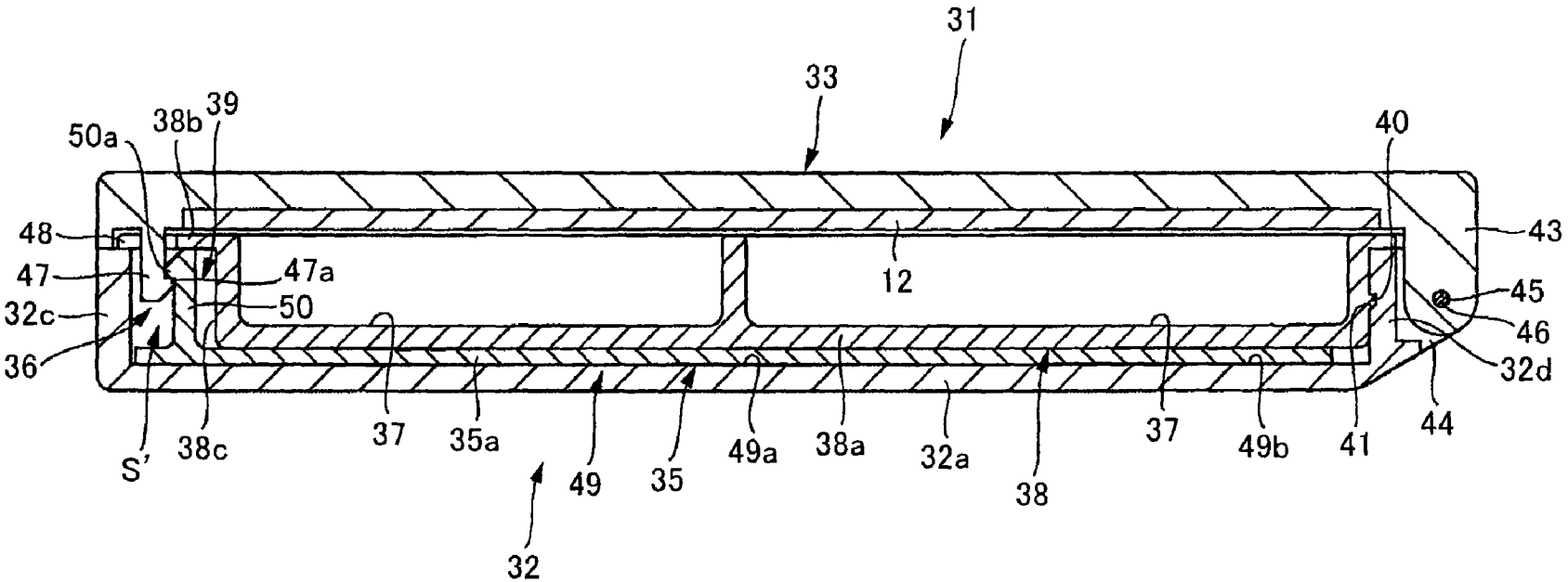
FIG. 8 is a side sectional view of the vanity case of FIG. 7.
Figure 9:
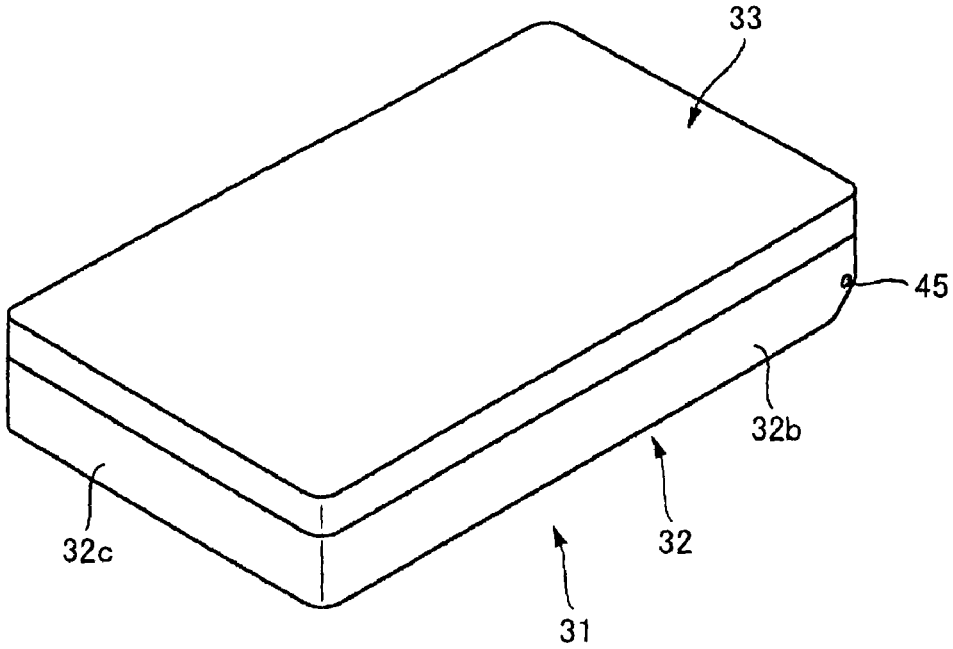
FIG. 9 is a perspective view of the vanity case of FIG. 7 as seen from above front.
Figure 10:
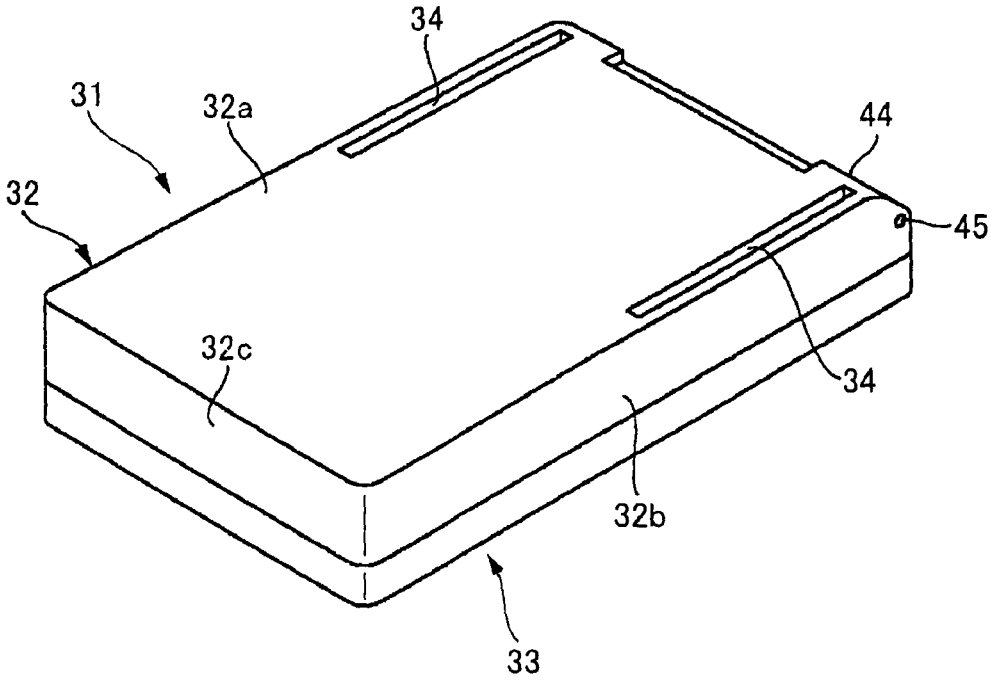
FIG. 10 is a perspective view of the vanity case of FIG. 7 as seen from below front.
Figure 11:
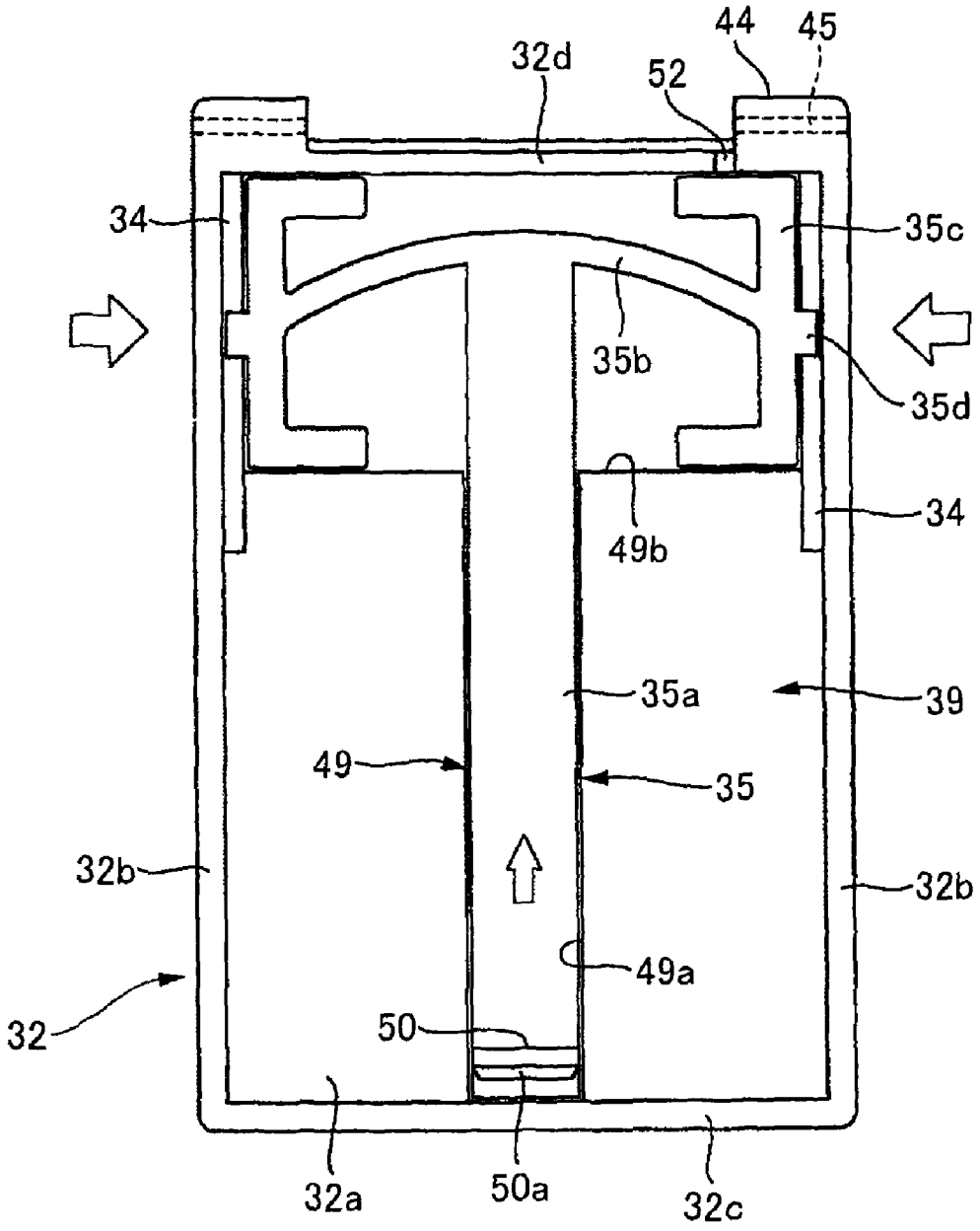
FIG. 11 is a plan view of the vanity case of FIG. 7 without the tray.
Figure 12:
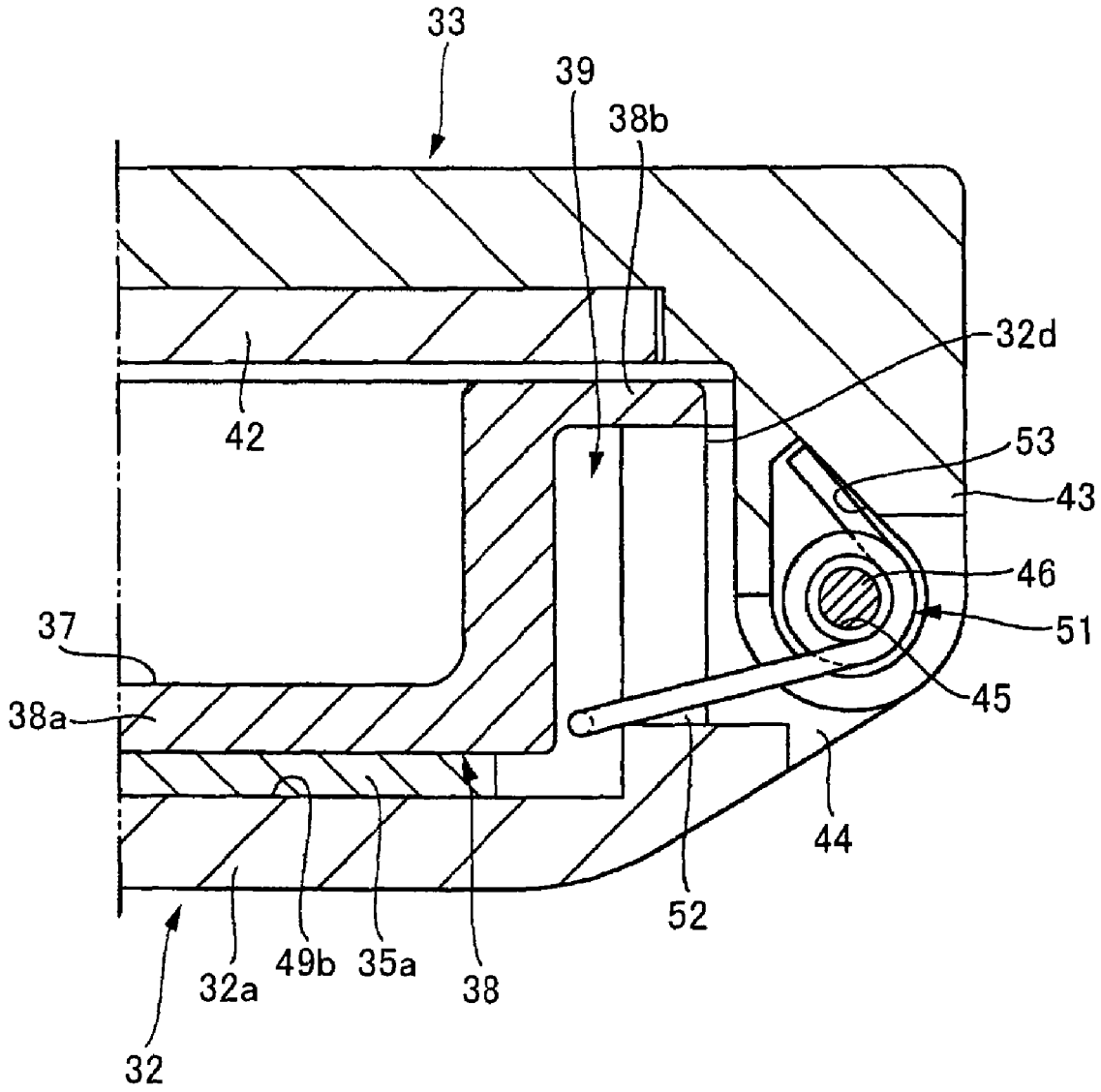
FIG. 12 is an enlarged sectional view of a main part of the vanity case of FIG. 7 showing a spring attached and its neighbors.
Figure 13:
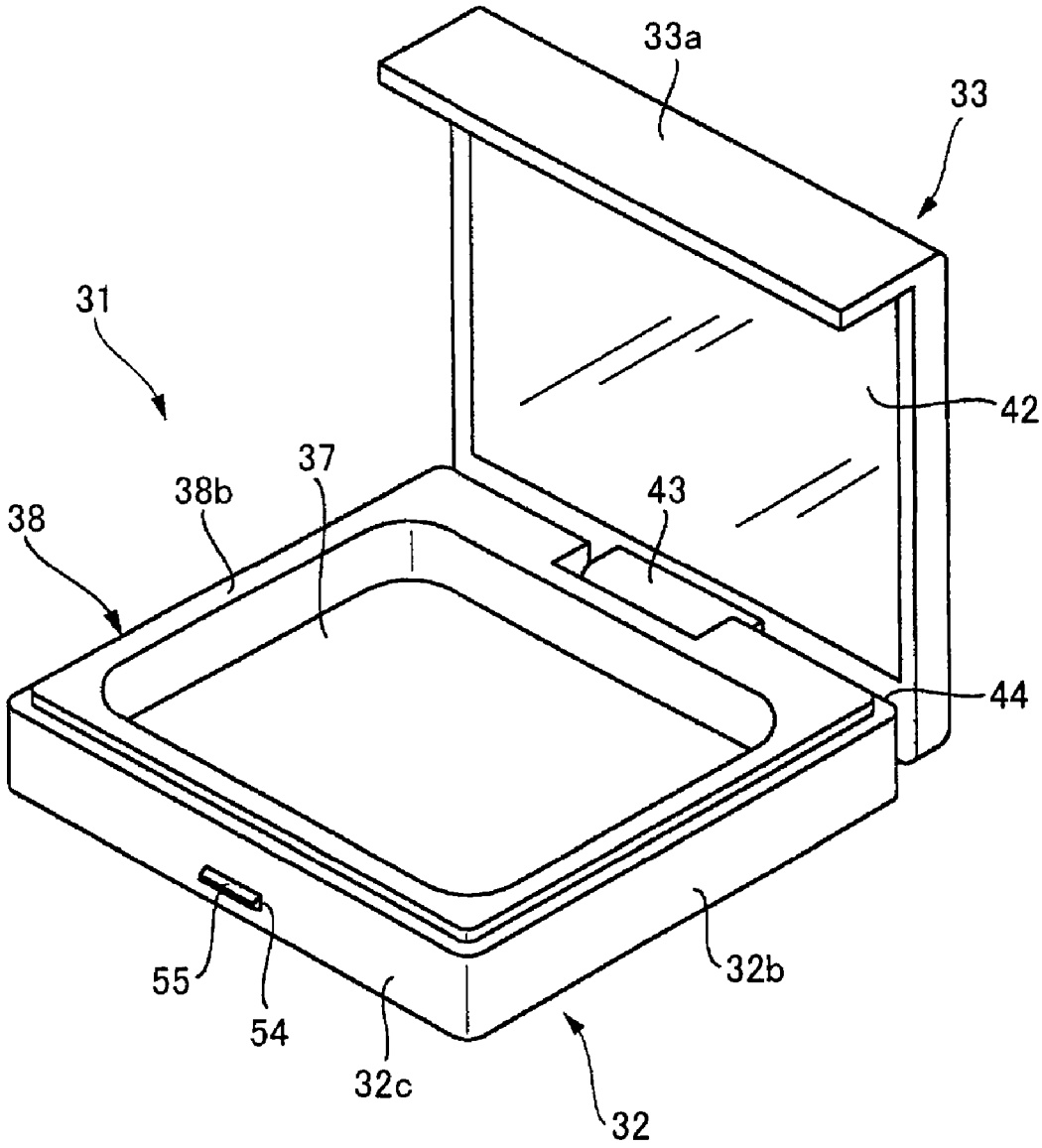
FIG. 13 is a perspective view of a modified example of the second embodiment of the vanity case according to the present invention.
Figure 14:
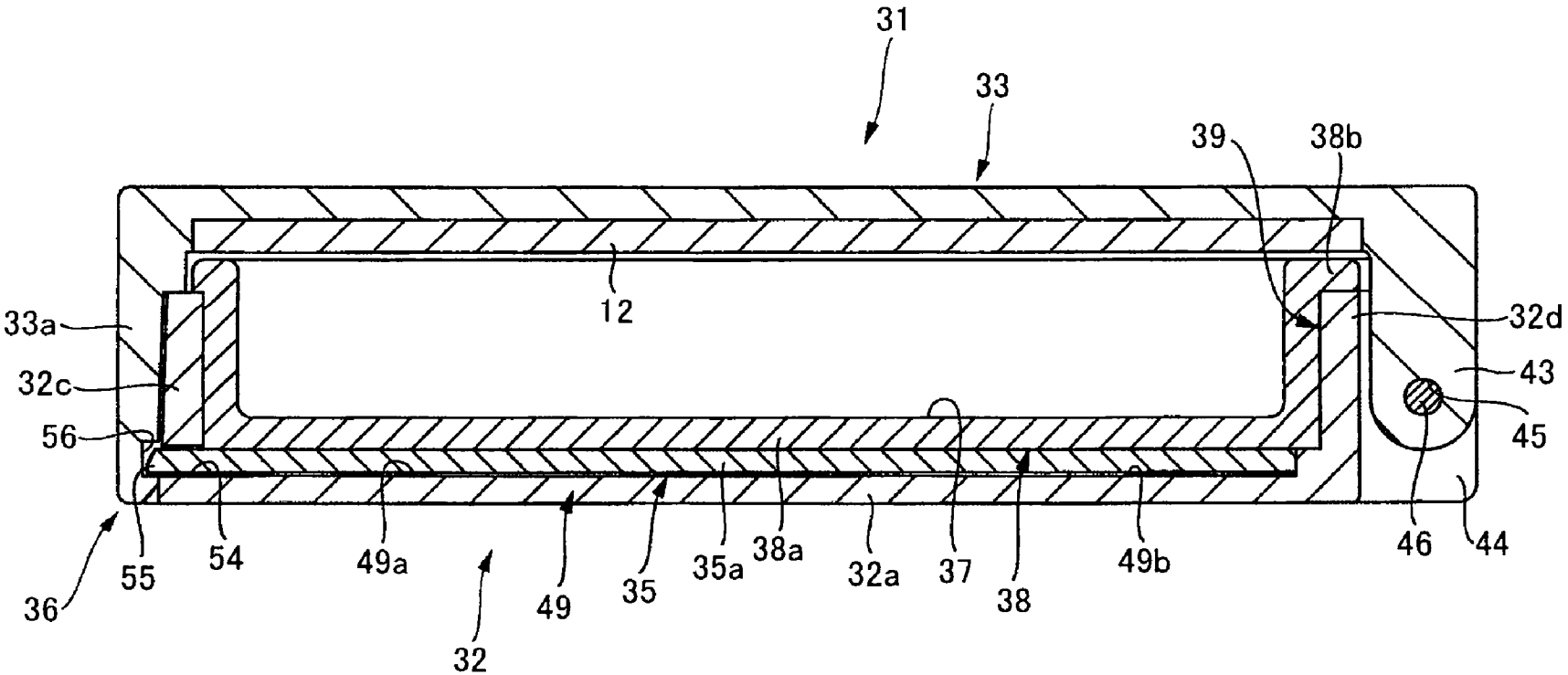
FIG. 14 is a side sectional view of the vanity case of FIG. 13.
Figure 15:
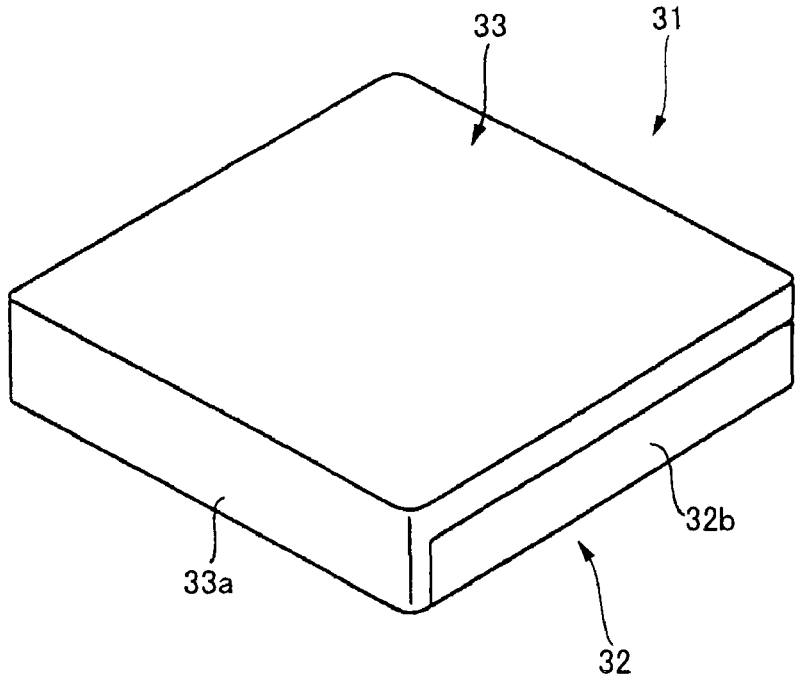
FIG. 15 is a perspective view of the vanity case of FIG. 13 as seen from above front.
Figure 16:
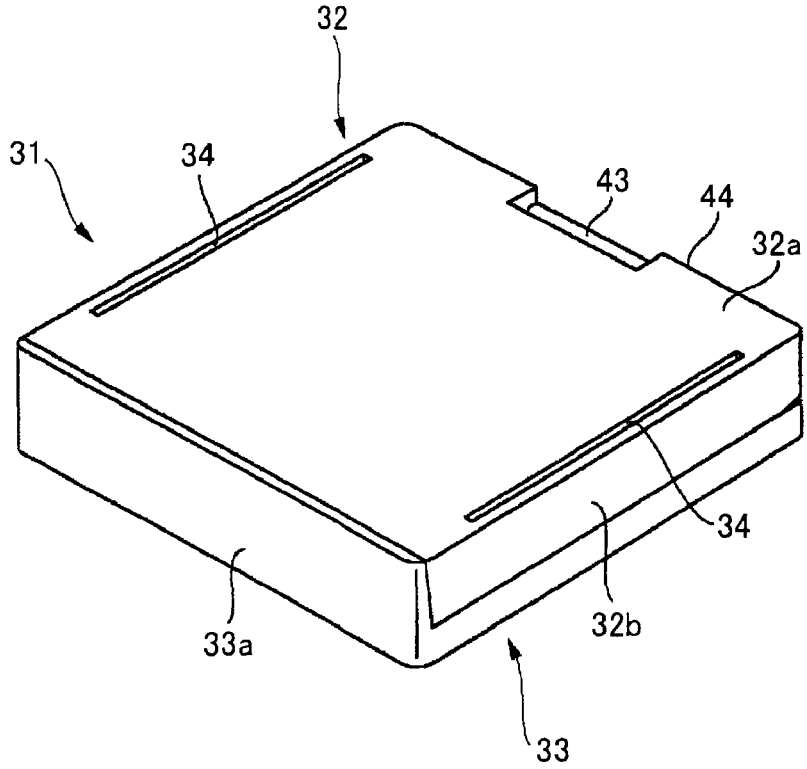
FIG. 16 is a perspective view of the vanity case of FIG. 13 as seen from below front.
Figure 17:
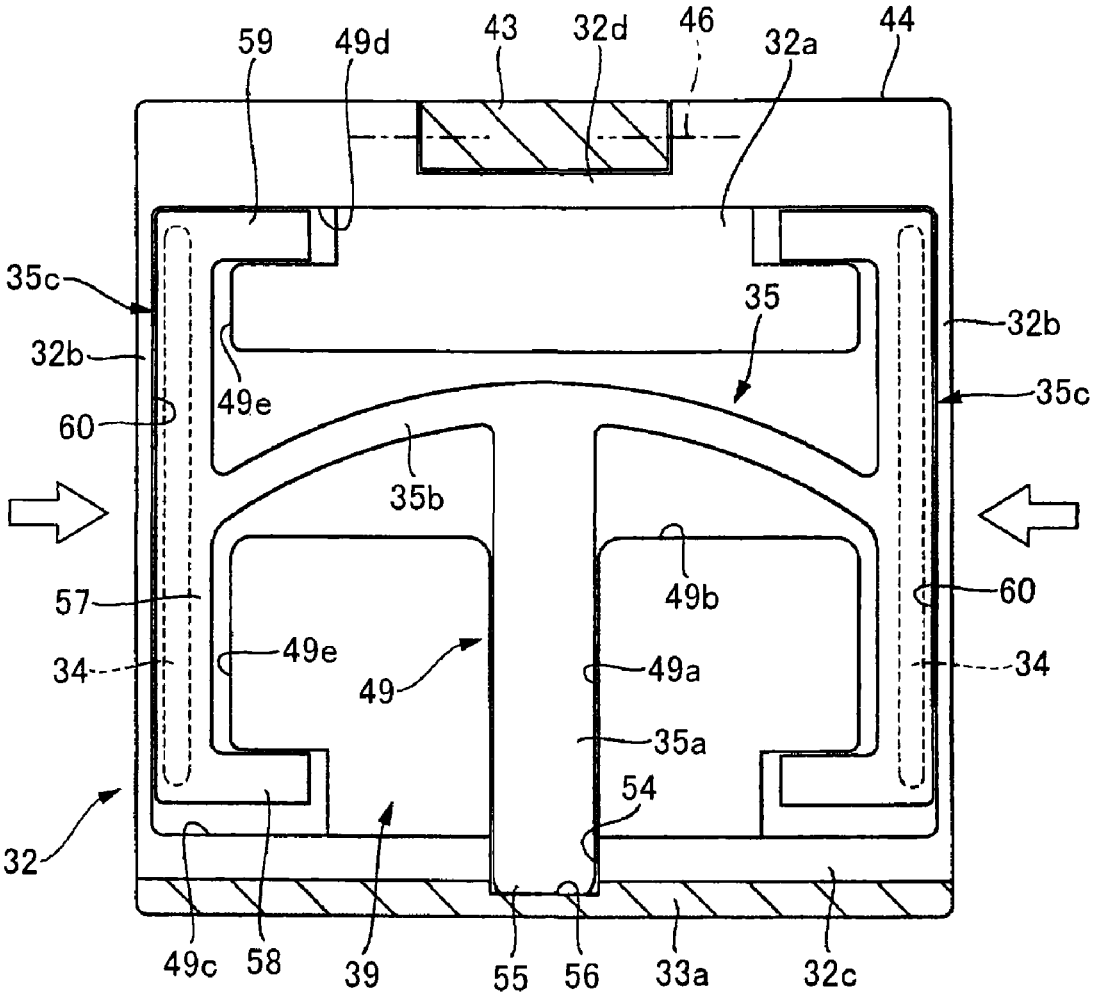
FIG. 17 is a plan view of the vanity case of FIG. 13 without the tray.
Figure 18:
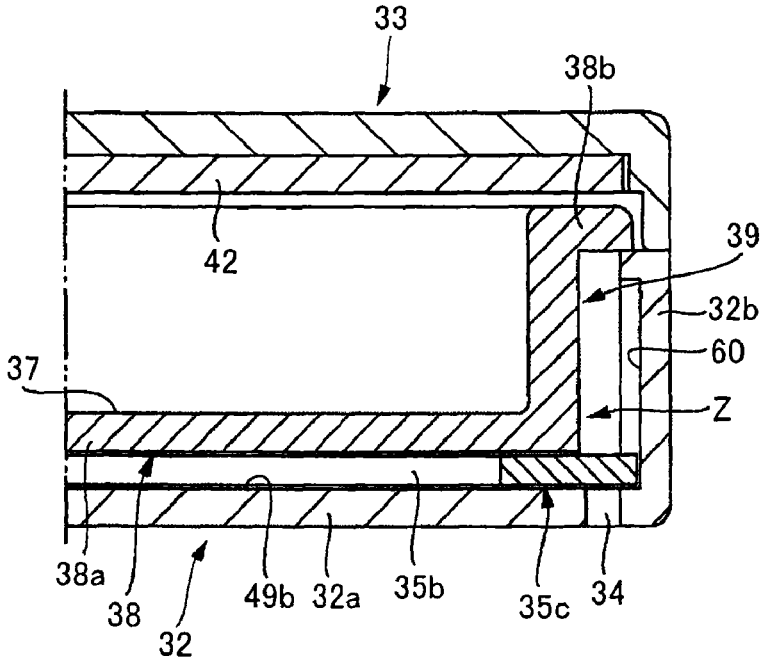
FIG. 18 is an enlarged sectional view of a main part of the vanity case of FIG. 13 showing a side wall and its neighbors.
Figure 19:
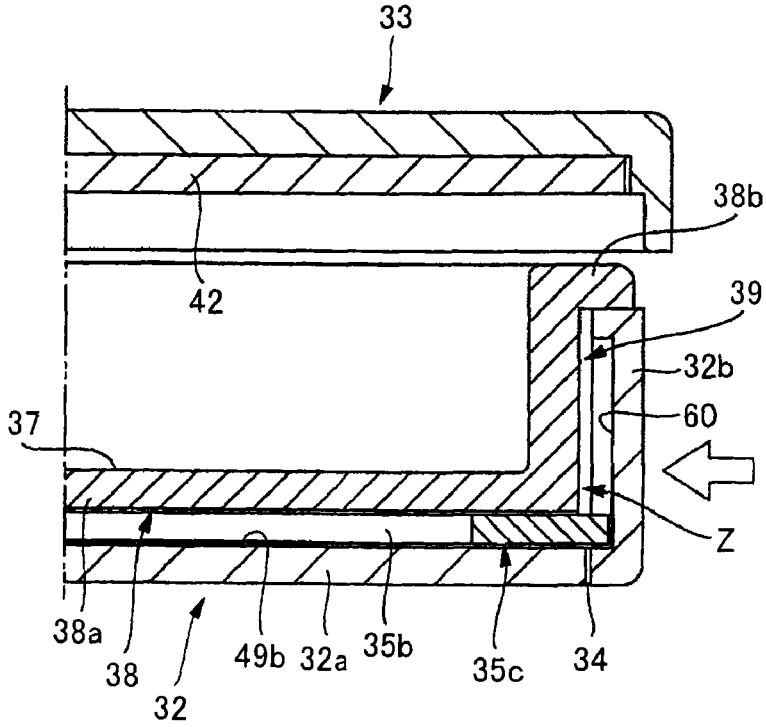
FIG. 19 is an enlarged sectional view of the main part of the vanity case of FIG. 13 showing the side wall being pushed.

FIG. 6 shows a modified example of the above embodiment. In this modified example, a raised portion 21 is formed protruding slightly forwards on the front wall 2*b* and functions as a mark indicating a suitable operation position. This raised portion 21 may be constituted by a nameplate. Since the vanity case 1 according to the present embodiment has appearances all of which are flat and is special and superior in design, there is concern that the portion for opening and closing operation may not be easy to find. However, the raised portion 21 can cause the user to recognize that the operation portion for opening and closing the lid 3 is on the front wall 2*b* of the case body 2. Needless to say, this modified example produces the same effect as the previously-described embodiment.

A second embodiment of the vanity case according to the present invention will be described below in detail with reference to the accompanying drawings. As shown in FIGS. 7 to 12, the vanity case 31 according to the present embodiment essentially comprises a case body 32 which has side walls 32*b* presenting continuous side appearance at the side edges of a bottom wall 32*a* and which a lid 33 is pivotably coupled to and openably closed against; slits 34 formed through the bottom wall 32*a* along the length of the side walls 32*b* that render the side walls 32*b* elastically deformable so as to be able to be pushed inwards of the case body 32; a slide piece 35 provided in the case body 32 so as to be slid in an elastically returnable manner by elastically deforming the side walls 32*b*, the slide piece 35 being hidden by the side walls 32*b*; and a hook 36 provided in between the slide piece 35 and the lid 33 so as to make the slide piece 35 detachably engage the lid 33 in response to the slide piece 35 sliding.

The case body 32 also has a front wall 32*c* and a rear wall 32*d* formed respectively at the front and rear ends of the bottom wall 32*a*, which together with the side walls 32*b* form a rectangle in outline in plan view. The left and right side walls 32*b* present the side appearance of the vanity case 31 that is continuous along their wall surface. Also the front wall 32*c* presents the front appearance of the vanity case 31 that is continuous along its wall surface. Formed in the case body 32 is a cavity 39 surrounded by the left and right side walls 32*b*, the front wall 32*c*, and the rear wall 32*d* which receives a tray 38 having two containers 37 that are filled with cosmetic material or store makeup tools. Engaging grooves 41 are formed in each of the sides of the front wall 32*c* and rear wall 32*d* facing the cavity 39 such that the grooves detachably engage a pair of engaging protrusions 40 formed on the front or rear of the tray 38 to hold the tray 38 in the cavity 39.

The lid 33 is formed to have a rectangle outline in plan view that matches that of the case body 32 and has a mirror plate 42 attached thereto. A hinge block 43 is formed extending downwards on the rear end of the lid 33, and a pair of hinge pieces 44 are formed on the case body 32 to protrude backwards from the left and right ends of the rear wall 32*d*. The hinge block 43 is inserted into between the hinge pieces 44, and by inserting a pair of hinge pins 46 into the hinge block 43 through pin openings 45 made in the hinge pieces 44, the lid 33 is pivotably coupled to the case body 32 to open and close against the case body 32. The hook 47 is formed on the underside of the middle of the front end of the lid 33 to extend downwards.

The slits 34 are formed extending longitudinally in the bottom wall 32*a* of the case body 32 along and adjacent to the pair of left and right side walls 32*b* respectively, and each side wall 32*b* is elastically deformable inwards by pushing operation with the presence of the slit 34. In the illustrated example, the slits 34 extending from the rear wall 32*d* have a length that is about half of that of the side wall 32*b*, but the length can be set as needed. For example, the slits 34 may be formed extending all along the length of the side wall 32*b*. Moreover, as to the locations of the slits 34, the slits 34 may be placed adjacent to the front wall 32*c* or in the middle along the side walls 32*b*, not being limited to the illustrated example where they are adjacent to the rear wall 32*d*.

The tray 38 comprises a tray body 38*a* provided with the engaging protrusions 40, and the canopy 38*b*. The tray body 38*a* has a rectangular outline in plan view whose lateral size is shorter than that of the cavity 39 in order to secure spaces Z that allow the side walls 32*b* to elastically deform and whose longitudinal size is substantially the same as that of the cavity 39. A recess 38*c* is formed in the middle of the front end of the tray body 38*a* by recessing inwards. Thus, a space S' between the tray 38 and the front wall 32*c* is formed. The canopy 38*b* is formed protruding outwards from the outer upper edge of the tray body 38*a* to the front wall 32*c*, the side walls 32*b*, and the rear wall 32*d* of the case body 32 to overlap them and to cover the space S' and the spaces Z. A recess 48 is formed in the front end of the canopy 38*a* through which the hook 47 of the lid 33 is inserted into the space S'.

Formed in the bottom wall 32*a* of the case body 32 is a T-shaped groove 49 made up of a longitudinal groove 49*a* extending from the front wall 32*c* backwards along the middle in the lateral direction of the case body 32 and a lateral groove 49*b* extending laterally between the pair of left and right slits 34 at the rear end of the longitudinal groove 49*a*. The thin plate-like slide piece 35 is provided in the groove 49.

The slide piece 35 comprises, and has integrally formed, a slide portion 35*a* that is slidable forwards and backwards in and under the guidance of the longitudinal groove 49*a*; elastic pieces 35*b* extending to the left and right from the rear end of the slide portion 35*a* that are elastically deformable in the lateral groove 49*b*; a pair of squared U-shaped guide pieces 35*c* formed at both ends of the elastic pieces 35*b* that are slidable to the left and right in and under the guidance of the lateral groove 49*b*; and push tabs 35*d* formed respectively on the guide pieces 35*c* to protrude toward the inside of the side walls 32*b*. When mounted in the groove 49, the slide piece 35 is hidden by the tray 38 and the side walls 32*b*.

The elastic pieces 35*b* of the slide piece 35 are shaped like an arc facing backwards. When the guide pieces 35*c* are slid inwards of the case body 32 in the lateral groove 49*b* that restricts their movement directions to the lateral direction, the elastic pieces 35*b* are elastically deformed backwards by the longitudinal groove 49*a* that restricts the movement direction of the slide portion 35*a* to the longitudinal direction, and thereby the slide portion 35*a* is slid backwards in the case body 32. When the elastic pieces 35*b* returns elastically, the guide pieces 35*c* are slid toward the side walls 32*b* and simultaneously, the slide portion 35*a* is slid forwards in the case body 32.

Thus, when the side walls 32*b* are elastically deformed inwards of the case body 32 by pushing operation, the guide pieces 35*c* are pushed via the push tabs 35*d* and slid inwards of the case body 32, and the slide portion 35*a* is slid backwards in the case body 32. In contrast, when pushing the side walls 32*b* is stopped, the elastic pieces 35*b* returns elastically, and the slide portion 35*a* is slid forwards in the case body 32, and simultaneously the guide pieces 35*c* are slid to the side walls 32*b*, so that the push tabs 35*d* contact the back sides of the side walls 32*b* and stop.

A leg 50 is formed upright on the front end of the slide portion 35*a* so as to be in the space S' between the front wall 32*c* and the tray 38, and the engaging portion 50*a* is formed on the upper end of the leg 50 to protrude forwards. The engaging portion 50*a* is moved in the space S' backwards and forwards in response to the slide portion 35*a* sliding. A tab 47*a* is formed on the lower end of the hook 47 of the lid 33 to protrude toward the rear of the case body 32 so as to detachably engage with the engaging portion 50*a* of the slide piece 35. The tab 47*a* and the engaging portion 50*a* form a hook 36 to hold the lid 33 closed.

Furthermore, a spring 51 is provided as a biasing member in between the rear wall 32*d* of the case body 32 and the hinge block 43 of the lid 33. A cut 52 is made in the rear wall 32*d* and a hole 53 is formed in one end of the hinge block 43. The spring 51 is received in the hole 53 with its one end fastened into the hole 53 and with the other end inserted into the case body 32 through the cut 52 and fastened to the rear wall 32*d* of the case body 32. When the lid 33 is closed, the spring 51 is twisted thereby activating resilience, which biases the lid 33 toward opening relative to the case body 32.

The actions of the vanity case 31 according to the present embodiment will be described. When assembling, the slide piece 35 is placed in the groove 49 in the case body 32, so that the slide piece 35 in the groove 49 is hidden by the side walls 32*b* and that the push tabs 35*d* contact the back sides of the side walls 32*b*. Then, with the spring 51 provided in between the hinge block 43 and the rear wall 32*d* of the case body 32, the hinge block 43 is placed between and coupled to the hinge pieces 44 by the hinge pins 46 so that the lid 33 is pivotably coupled to the case body 32. Thereafter, the tray 38 is mounted in the cavity 39. Thus, the engaging portion 50*a* of the slide piece 35 is located in the space S', and the space S', the spaces Z between the side walls 32*b* and the tray 38, and the slit 34 are hidden by the tray 38.

In the use of the vanity case 31, by closing the lid 33, the hook 47 of the lid 33 enters into the space S' through the recess 48 made in the canopy 38*b* of the tray 38. The tab 47*a* of the hook 47 that has entered the space S' contacts and pushes the engaging portion 50*a* toward the rear of the case body 32. When the engaging portion 50*a* is pushed, the slide portion 35*a* of the slide piece 35 is slid backwards against the resilience of the elastic pieces 35*b*, and thus the tab 47*a* gets under and engages with the engaging portion 50*a*, thereby holding the lid 33 closed against the case body 32.

Conversely, to open the lid 33, the side walls 32*b* of the case body 32 are pushed with fingers or the like. By pushing the side walls 32*b* inwards of the vanity case 31, the guide pieces 35*c* are pushed via the push tabs 35*d* and slid from both sides inwards of the case body 32, thereby elastically deforming the elastic pieces 35*b* backwards, and thus the slide portion 35*a* is slid backwards in the case body 32. By this slide movement of the slide portion 35*a*, the engaging portion 50*a* of the slide piece 35 disengages from the tab 47*a* of the hook 47. Thus, the spring 51 raises the lid 33 from the case body 32 to open.

Once the lid 33 is raised by the action of the spring 51, when the slide piece 35 returns elastically, the engaging portion 50*a* will not engage the hook 47, and thus the lid 33 can be smoothly opened. After the lid 33 is raised by the spring 51, by removing the fingers from the side walls 32*b*, the slide portion 35*a* and the guide pieces 35*c* are slid respectively forwards and toward the side walls 32*b* because of the elastic return action of the elastic pieces 35*b*, and the push tabs 35*d* of the guide pieces 35*c* contact the back sides of the side walls 32*b*, stop, and wait for the closing of the lid 33 again.

In the vanity case 31 according to the present embodiment, the slide piece 35 is hidden by the side walls 32*b* presenting the side appearance of the vanity case 31. Hence, as opposed to the conventional vanity case, the design of the vanity case is not subject to restriction by push pieces that would be exposed at the sides of the case body, and thus the degrees of freedom in appearance design can be made greater. Also, the portion for pushing operation that would otherwise be exposed in outer appearance can be prevented from becoming dirty, and thus the beauty of the portion for pushing operation can be maintained appropriate structurally. In addition, a wide portion of the side wall 32*b* can be used as the portion for pushing operation, so that any part of the wide portion can be pushed to open the lid 33 thus improving operability. Further, because the pair of slits 34 are formed corresponding to the pair of left and right side walls 32*b* of the case body 32, the slide piece 35 can be slid with a smaller operation force than in the case where a slit 34 is provided for only one side wall 32*b*.

Moreover, because the spring 51 biasing the lid 33 toward opening is provided in between the case body 32 and the lid 33, once the engagement between the engaging portion 50*a* and the hook 47 is released by pushing the side walls 32*b*, they will not engage again when the fingers are removed from the side walls 32*b*, and thus the lid 33 can be opened smoothly.

In the above second embodiment, a slit 34 is formed for each of the pair of side walls 32*b*, but a slit 34 may be formed for either of the side walls 32*b*.

FIGS. 13 to 19 show a modified example of the vanity case 31 of the second embodiment according to the present invention. In the modified example, as opposed to the above embodiment, an opening 54 is formed through the front wall 32*c* of the case body 32, through which opening the front end of the slide portion 35*a* of the slide piece 35 is inserted and exposed outside the opening. A extending-down front wall 33*a* is formed at the front end of the lid 33 so as to cover the entire front wall 32*c* from front. The extending-down front wall 33*a* has a U-shaped groove-like engaging portion 56 formed in its back side facing the front wall 32*c* of the case body 32, which detachably engages with a front end 55 of the slide piece 35 exposed outside the opening 54 of the front wall 32*c*. The engaging portion 56 of the front wall 33*a* and the exposed front end 55 of the slide piece 35 form a hook 36.

Furthermore, in the present modified example, a front groove 49*c* and a rear groove 49*d* are formed respectively to guide the sliding of a front portion 58 and a rear portion 59 that are bent inwards of the case body 32 relative to a base 57 extending in the longitudinal direction of the case body 32 of a squared U-shaped guide piece 35*c*. The front groove 49*c* and the rear groove 49*d* are connected to a lateral groove 49*b* through a link groove 49*e* that allows the base 57 to slide inwards of the case body 32. No push tab 35*d* is provided. The hook 36 is made up of the exposed portion 55 of the slide portion 35*a* and the engaging portion 56.

And the slits 34 are formed extending almost all along the length of the side walls 32*b*. Formed in the inside of the side walls 32*b* facing the cavity 39 are recesses 60 along the length of the slits 34, and the base 57 of the guide piece 35*c* is formed to have such a width that the base 57 extends over the slit 34 into the recess 60. The base 57 of the guide piece 35*c* functions as a seal to seal the slit 34 from the inside of the case body 32. Further, in the present modified example, the tray 38 has only one container 37 and not the space S' between the tray 38 and the front wall 32*c*.

Also in the present modified example, the vanity case 31 can be assembled by incorporating the slide piece 35 in the case body 32 and coupling the lid 33 to the case body 32 and mounting the tray 38 in the cavity 39. The operation of closing and opening the lid 33 can be performed like in the previously-described embodiment. To open the lid 33, by pushing the side walls 32*b* of the case body 32 with fingers or the like, the guide pieces 35*c* are pushed via the base 57 of the guide piece 35*c* inserted into the recess 60 and slid from both the left and right sides inwards of the case body 32 with maintaining the sealing of the slits 34, and thus the slide portion 35*a* is slid backwards in the case body 32 and the exposed portion 55 of the slide piece 35 disengages from the engaging portion 56 and retracts into the case body 32 through the opening 54. Therefore, the lid 33 can be opened.

In particular, in the present modified example, instead of the recess 48 of the canopy 38*b* of the previous embodiment, the opening 54 is formed in the front wall 32*c* of the case body 32, and the exposed portion 55 of the slide portion 35*a* outside the opening 54 detachably engages with the engaging portion 56 of the lid 33. Hence, the space S' need not be provided and the capacity of the tray 38 can be increased, thus increasing the requisite amount of cosmetic material to fill the container 37. Also, because the container 37 of the tray 38 is separated greatly from the opening 54 via the upper end of the front wall 32*c*, cosmetic material or the like can be prevented from entering the case body 32 through the opening 54 and sticking. Moreover, because the base 57 of the guide piece 35*c* is configured to seal the slit 34 from the inside of the case body 32, dust or the like can be prevented from entering the case body 32 through the slit 34. Also, the structure of the hook 36 can be simplified over that of the previous embodiment.

Figure 20:
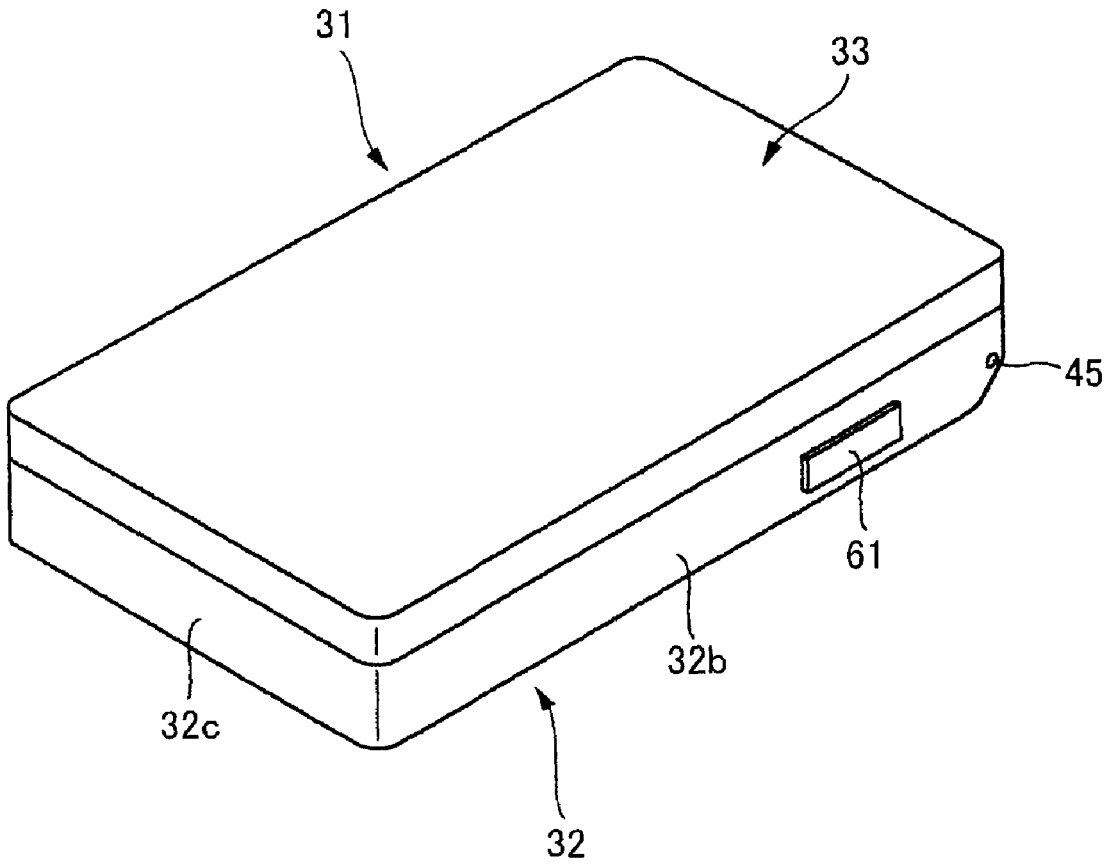
FIG. 20 is a perspective view of another modified example of the second embodiment according to the present invention as seen from above front.

FIG. 20 shows another modified example of the second embodiment. In this modified example, raised portions 61 are formed protruding slightly sideward from the side walls 32*b* and function as marks indicating the operation position. The raised portions 61 may be constituted by a nameplate. Since the vanity case 31 according to the present embodiment has appearances all of which are flat and is special and superior in design, there is concern that the operation portion for opening and closing the lid 33 may be not easy to find. However, the raised portions 61 can cause the user to recognize that the operation portions for opening and closing the lid 33 are on the side walls 32*b* of the case body 32. Needless to say, this modified example produces the same effect as the previous embodiment.

What is claimed is:

1. A vanity case in which a lid is coupled to a peripheral wall on a rear side of a case body in an openable and closable manner and a slide piece is slidably mounted in the case body such that when the slide piece is at a first position, the lid is closed against the case body and when the slide piece has moved from the first position to a second position, the lid is open relative to the case body, wherein slits are formed through a bottom wall of the case body adjacent to peripheral side walls on both left and right sides of the case body such that the peripheral side walls adjacent to the slits elastically deform inwards when an inward external force is exerted on the peripheral side walls; the peripheral side walls have continuous side appearance; the slide piece provided in the case body is hidden by the peripheral side walls; and the deformation of the peripheral side walls acts as an external force on the slide piece to make the slide piece move from the first position to the second position.

2. The vanity case according to claim 1, wherein a hook is provided in between the slide piece and the lid so as to make the slide piece detachably engage when the slide piece is at the first position.

3. The vanity case according to claims 1 or 2, wherein the case body has a front wall having formed therein an opening through which a front end of the slide piece is inserted and exposed outside the opening, and the lid has an extending-down front wall that covers the front wall and whose surface presents continuous front appearance, and the front end of the slide piece detachably engages with part of a rear portion of the extending-down front wall of the lid.

4. The vanity case according to claims 1 or 2, wherein the slide piece has a sealing portion for sealing the slits from the inside of the case body.

5. The vanity case according to claims 1 or 2, wherein a biasing member is provided in between the case body and the lid for urging the lid toward opening.

6. The vanity case according to any of claims 1 or 2, wherein the peripheral side walls are each provided with a mark indicating a position for pushing operation.

* * * * *